United States Patent [19]

Carey, Jr.

[11] 4,284,204

[45] Aug. 18, 1981

[54] DIMPLED TRAY PACKAGE WITH SELF-LOCKING FEATURE

[75] Inventor: Howard M. Carey, Jr., Staunton, Va.

[73] Assignee: American Safety Razor Company, Verona, Va.

[21] Appl. No.: 92,116

[22] Filed: Nov. 7, 1979

[51] Int. Cl.[3] ..... B65D 43/20

[52] U.S. Cl. ..... 220/346; 220/8; 220/281; 206/1.5

[58] Field of Search ..... 220/8, 345, 346, 281; 206/1.5; 229/7 SC

[56] References Cited

U.S. PATENT DOCUMENTS

| | | | |
|---|---|---|---|
| 3,942,630 | 3/1976 | Phillips | 220/346 X |
| 4,007,828 | 2/1977 | Mayled | 220/8 X |

FOREIGN PATENT DOCUMENTS

| | | | |
|---|---|---|---|
| 568471 | 10/1957 | Italy | 220/346 |

*Primary Examiner*—George T. Hall

*Attorney, Agent, or Firm*—Wender, Murase & White

[57] ABSTRACT

A two-part package includes a sleeve for receiving a tray. One surface of the sleeve has openings formed therein for receiving dimpled detents formed in the tray. As the tray is fully positioned in the sleeve, the detents engage the openings and retain the tray thereby inhibiting unwanted opening of the package and release of contents. Upon exertion of sufficient manual force on the sides of the sleeve, detent action is overcome and the package is opened as desired.

8 Claims, 3 Drawing Figures

DIMPLED TRAY PACKAGE WITH SELF-LOCKING FEATURE

FIELD OF THE INVENTION

The present invention relates to package construction and more particularly to such a construction for locking a sliding tray within a surrounding sleeve.

BRIEF DESCRIPTION OF THE PRIOR ART

A basic package for materials consists of a tray or box slideably retained within a sleeve, such as the well-known matchbox. When light materials, such as stick matches are to be packaged, a close fit between the sleeve and tray portions of the package generally accomplishes the retention of the contents without unwanted package opening and spilling of the contents. However, if the contents are of a heavier sort, such as made from metal, the resistance between the sleeve and the tray no longer becomes sufficient to prevent sliding opening of the package if the package is turned about.

In conjunction with the retention of heavier materials, it is possible to use fasteners between the package parts which unfortunately increases the cost of a package and makes the opening of such a package less convenient.

As the result of a prior art patent search, the following U.S. patents were uncovered:

U.S. Pat. No. 4,007,828 discloses a sleeve-tray package wherein projections are formed in the outer wall of a double wall tray. The projection is received within an opening in a mating sleeve member. In order to overcome latching action between the projection and the opening, force must be directly exerted against the projection while the tray is pushed out from the sleeve.

U.S. Pat. No. 3,568,827 shows a package construction wherein a resilient spring member attached to a first portion of the package engages a stop of a second package portion. In order to open the package, inward pressure must be brought to bear against the resilient member.

U.S. Pat. No. 3,051,366 shows a sliding box construction wherein the edges of a sliding tray are contoured in a manner to frictionally engage a receiving sleeve.

U.S. Pat. No. 2,690,199 discloses an envelope with indentations formed within telescoping members which frictionally engage one another so that the package remains closed until mating portions of the envelope are physically separated from one another.

U.S. Pat. No. 1,682,449 shows a sliding package configuration wherein indentations formed in the outer container coincide with an opening in the inner container. The indentations are not structured to achieve locking action between the inner and outer container. Rather, the indentations are formed of a sealing material to prevent the contents of the inner container from spilling.

BRIEF DESCRIPTION OF THE PRESENT INVENTION

The present invention is directed to a simple modification of the basic two-part sleeve/tray package, each of single wall thickness which maintains closure between the parts even when the package is turned about with heavy contents therein. By forming a dimpled detent or projection in the tray and by further forming corresponding openings in a confronting side of the sleeve, detent action is achieved to maintain the parts in interlocked relationship until the sides of the sleeve are pressed in and a sufficient pushing force is exerted on the tray. Thus, when the package includes relatively heavy contents, such as razor blades, the package will remain securely closed until a user wishes to open the package by simply pushing the tray out from the sleeve while pressing against the sleeve side panels. The formation of a detent in the tray and mating openings in the sleeve accomplishes detent action between the package parts at insignificant cost while retaining the simplicity of the package.

The above-mentioned objects and advantages of the present invention will be more clearly understood when considered in conjunction with the accompanying drawings, in which:

DETAILED DESCRIPTION OF THE INVENTION

Figure 1:
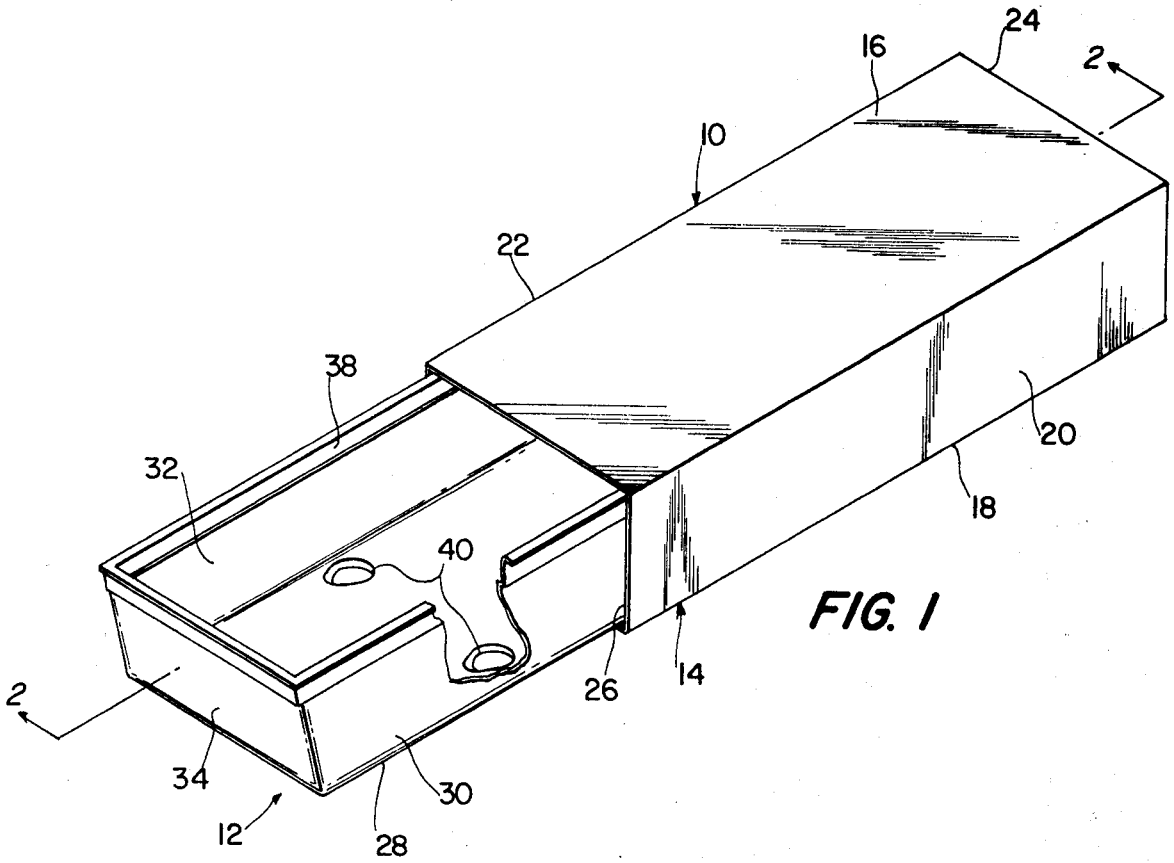
FIG. 1 is a perspective view of the present inventive package showing the tray in partially removed relation to the sleeve and with a portion of the tray shown cut away to reveal two adjacent dimpled detents.

Referring to the figures, and more particularly FIG. 1 thereof, a package is generally indicated by reference numeral 10 and is seen to include a tray portion 12 received within a sleeve 14. In a preferred embodiment of the invention, the tray 12 is fabricated from plastic while the sleeve may be of paper or plastic. Of course, other suitable materials can be employed. The sleeve 14 includes top and bottom panels 16 and 18, respectively, and side panels 20 and 22. In the illustrated embodiment, both ends 24 and 26 of the sleeve are opened.

The tray 12 includes a bottom panel 28 connected to tapered side panels 30 and 32. The tapered tray leaves a slight void between the lower portions of side panels 30, 32 and confronting portions of sleeve side panels 20 and 22. Thus, by pressing against sleeve side panels 20 and 22, the sleeve bottom panel 18 bows and the projections 40 are released from their mating opening 42. End panels 34 and 36 define the boundary of tray 12. A step-down ledge 38 is preferably molded into the upper opening of tray 12 in order to enhance the rigidity of the tray.

Thus far, the components described constitute conventional packaging construction. It is the addition of simple elements to the two basic package parts which achieves detent action between the tray and the sleeve thereby permitting the tray to be locked in position within the sleeve and ensure safe and convenient containment of the contents until the sleeve side panels are pressed in and sufficient pushing force is exerted against the tray thereby overcoming the detent action.

Figure 2:
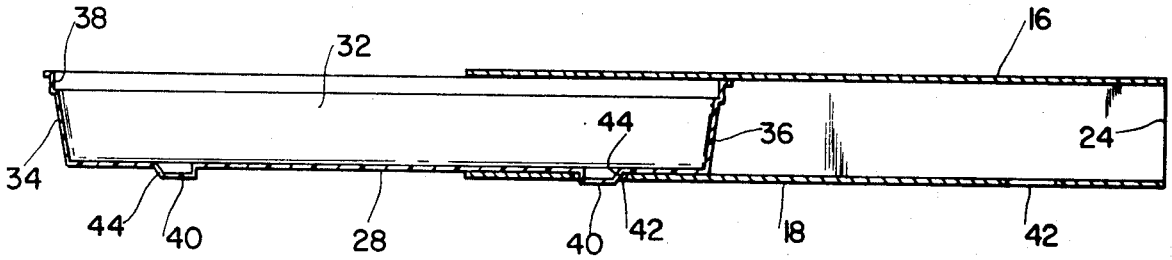
FIG. 2 is a longitudinal cross-sectional view taken along section line 2—2 of FIG. 1.
Figure 3:
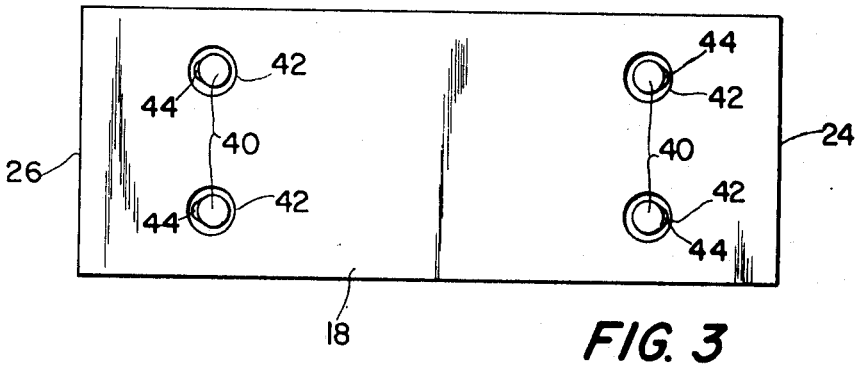
FIG. 3 is a bottom plan view of a closed package.

In order to achieve the novel detent action, dimpled detents or projections 40 are molded into the bottom panel 28 of the tray 12 as shown in all the figures. These detents are received, as shown in FIGS. 2 and 3, in mating openings 42 which are in rectangular spaced relationship to each other on the bottom panel 18 of the sleeve 14. Although the detents and openings have been located in the bottom panels of the tray and sleeve, it is to be understood that this can be achieved on the side panels of the tray and sleeve members as well.

It should be further noted that although the detents 40 are shown and described as being formed in tapered tray 12, they may be equivalently formed in the sleeve 14 while the openings 42 are formed in the tray 12. Also, although four such detents and openings are illustrated, any number may be used.

It will be noted that the dimpled detents 40 are simple formations. That is, they do not include separate spring-biasing members for other separate components. Rather, the elasticity of the sleeve 14, relative to the detents 40, is relied upon to achieve the desired detent action.

In operation of the package, when the tray is opened with respect to the sleeve, as shown in FIG. 1, the two package members are free to move relative to one another. However, when the tray 12 is fully inserted within sleeve 14 so that the detents 40 engage the openings 42, the tray is no longer able to freely move out from the sleeve such as would occur if relatively heavy contents were positioned in the package and the package was stood end up. Once the package is closed, in order to open it, the sleeve side panels 20 and 22 are pressed in and to overcome the detent action force is then exerted against tray 12. Only then can the tray be opened relative to the sleeve.

The detents 40 may be provided with ramps 44 extending from the surface of the tray to the top of each detent, as shown most clearly in FIG. 2. The ramps 44 allow the bottom panel 18 of the sleeve 14 to slide over the detents 40 when the tray is being inserted into the sleeve. Once the detents 40 engage the openings 42, the tray is held in place and can be removed only in the manner set forth above. Thus, each ramp 44 is directed towards either end panel 34 or 36, with the totality of detents 40 provided with ramps 44 facing in both said directions so as to permit the tray to be inserted into the sleeve from either end 34 or 36.

It should be understood that the invention is not limited to the exact details of construction shown and described herein for obvious modifications will occur to persons skilled in the art.

What is claimed is:

1. A package comprising:

a tray constructed from panels articulating from one another;

a sleeve for receiving said tray;

said tray including tapered side panels;

detent means formed in a bottom panel of said tray;

means formed in a bottom of said sleeve for receiving said detent means when said tray is inserted to a predetermined position within said sleeve thereby locking said tray in said sleeve;

said sleeve having side walls cooperating with said tapered side panels of said tray so as to create voids between respective side panels and side walls when said tray is inserted in said sleeve; and said bottom wall of said sleeve being deformable and cooperating with said side walls of said sleeve so as to release said detent means from engagement with said receiving means upon the exertion of sufficient forces against said side walls of said sleeve thereby allowing said tray to be displaced from said sleeve.

2. A package as recited in claim 1 wherein said detent means is at least one dimpled projection extending from a surface of said bottom panel of said tray.

3. A package as recited in claim 1 wherein said detent receiving means comprises an opening formed in said bottom wall of said sleeve which confronts said detent means.

4. A package as recited in claim 1 wherein said detent means is at least one dimpled projection extending from a surface of said bottom panel of said tray and said detent receiving means comprises an opening formed in said bottom wall of said sleeve which confronts said detent means.

5. A package as recited in claims 2 or 4 wherein said dimpled projection is provided with a ramp extending from said surface of said bottom panel towards the top of said projection.

6. A package as recited in claim 5 wherein said tray includes end panels and said ramp is directed towards one of said end panels.

7. A package as recited in claim 6 wherein said tray has a plurality of dimpled projections each having a ramp directed towards one of said end panels.

8. A method for acheiving locking closure of a first package member within a second package member and unlocking thereof, comprising the steps of:

providing the first member with tapered side panels and dimpled projections on a bottom panel;

providing the second member with side walls and a deformable bottom wall having openings, each of said side walls cooperating with a respective one of said tapered side panels so as to form voids therebetween and said openings receiving said projections when said first and second members are brought into package-closing relationship with each other;

moving said first member into said second member so as to bring the same into package-closing relationship with each other and to permit engagement between said projections and said openings thus acheiving locking closure; and deforming said bottom wall of said second member by exerting force upon said side walls of said second member adjacent the voids to disengage said projections from said openings thus unlocking said first and second members.

* * * * *